US011844441B2

(12) United States Patent
Sim et al.

(10) Patent No.: US 11,844,441 B2
(45) **Date of Patent: *Dec. 19, 2023**

(54) CHAIR SYSTEM WITH AN UNTETHERED CHAIR WITH SPEAKERS

(71) Applicant: CREATIVE TECHNOLOGY LTD, Singapore (SG)

(72) Inventors: Wong Hoo Sim, Singapore (SG); Kee Seng Tan, Singapore (SG); Yam Fei Lian, Singapore (SG)

(73) Assignee: CREATIVE TECHNOLOGY LTD, Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 18/128,146

(22) Filed: Mar. 29, 2023

(65) Prior Publication Data

US 2023/0292926 A1 Sep. 21, 2023

Related U.S. Application Data

(63) Continuation of application No. 17/135,373, filed on Dec. 28, 2020, now Pat. No. 11,641,945.

(51) Int. Cl.

| | |
|---|---|
| ***H04R 5/00*** | (2006.01) |
| ***H04B 3/00*** | (2006.01) |
| ***A47C 1/032*** | (2006.01) |
| ***A47C 7/72*** | (2006.01) |

(52) U.S. Cl.
CPC ..... *A47C 7/727* (2018.08)

(58) Field of Classification Search
CPC .. A47C 7/72; A47C 7/62; A47C 7/727; A47C 31/008
See application file for complete search history.

(56) References Cited

U.S. PATENT DOCUMENTS

| | | | | |
|---|---|---|---|---|
| 2,838,095 | A * | 6/1958 | Deaton | A47C 7/443 297/301.4 |
| 7,378,978 | B2 | 5/2008 | Cassaday | |
| 8,016,351 | B2 | 9/2011 | Cassaday | |
| 8,340,313 | B2 * | 12/2012 | Caffrey | H04R 5/04 381/1 |
| 8,553,890 | B2 | 10/2013 | Yokota | |
| 8,668,045 | B2 | 3/2014 | Cohen | |
| 8,823,782 | B2 * | 9/2014 | Karaoguz | H04N 21/42222 348/51 |

(Continued)

FOREIGN PATENT DOCUMENTS

| | | |
|---|---|---|
| EP | 3419309 | 12/2018 |
| WO | 2009076250 | 6/2009 |

OTHER PUBLICATIONS

USPTO, Non-Final Office Action dated Oct. 26, 2021 in U.S. Appl. No. 17/135,373.

(Continued)

*Primary Examiner* — Shin H Kim
(74) *Attorney, Agent, or Firm* — SNELL & WILMER L.L.P.

(57) ABSTRACT

A chair system including a main unit and an untethered chair is provided. The main unit includes a wireless transmitter, a subwoofer, an audio stream receiver and a processor. The untethered chair includes a plurality of speakers, a power source and a wireless receiver for receiving a processed audio stream from the main unit.

20 Claims, 6 Drawing Sheets

(56) References Cited

U.S. PATENT DOCUMENTS

| | | | | |
|---|---|---|---|---|
| 8,845,016 | B2 | 9/2014 | Domash | |
| 9,022,468 | B2 | 5/2015 | Shalaby | |
| 9,185,492 | B2 * | 11/2015 | Afshar | H04R 7/24 |
| 9,198,523 | B2 * | 12/2015 | Cassaday | A47C 1/022 |
| 9,277,296 | B2 | 3/2016 | Cassaday | |
| D864,894 | S * | 10/2019 | Kim | D14/204 |
| D864,895 | S * | 10/2019 | Kim | D14/204 |
| 2007/0001494 | A1 | 1/2007 | Hoover | |
| 2008/0111408 | A1 | 5/2008 | Duran | |
| 2008/0212971 | A1 | 9/2008 | Shaanan | |
| 2008/0247554 | A1 | 10/2008 | Caffrey | |
| 2010/0260371 | A1 * | 10/2010 | Afshar | H04R 7/24 340/407.1 |
| 2010/0320819 | A1 | 12/2010 | Cohen | |
| 2012/0051579 | A1 * | 3/2012 | Cohen | H04R 5/04 381/388 |
| 2012/0223555 | A1 | 9/2012 | Brown, Jr. | |
| 2013/0170647 | A1 * | 7/2013 | Reilly | H04R 27/00 381/17 |
| 2013/0270880 | A1 | 10/2013 | Lee | |
| 2013/0338804 | A1 * | 12/2013 | Sheen | H04L 12/2838 398/180 |
| 2014/0334637 | A1 | 11/2014 | Oswald et al. | |
| 2015/0313367 | A1 | 11/2015 | Grooters | |
| 2016/0183687 | A1 | 6/2016 | Hoyt | |
| 2016/0195923 | A1 | 7/2016 | Nauseef | |
| 2018/0255398 | A1 | 9/2018 | Fischer | |
| 2019/0289395 | A1 | 9/2019 | Fischer | |
| 2021/0243544 | A1 * | 8/2021 | Tracey | H04S 3/008 |

OTHER PUBLICATIONS

USPTO, Final Office Action dated May 18, 2022 in U.S. Appl. No. 17/135,373.

USPTO, Advisory Action dated Aug. 3, 2022 in U.S. Appl. No. 17/135,373.

USPTO, Non-Final Office Action dated Nov. 8, 2022 in U.S. Appl. No. 17/135,373.

USPTO, Notice of Allowance dated Mar. 22, 2023 in U.S. Appl. No. 17/135,373.

European Patent Office, European Search Report dated May 18, 2022 in Application No. 21213540.4.

* cited by examiner

200

400

CHAIR SYSTEM WITH AN UNTETHERED CHAIR WITH SPEAKERS

CROSS-REFERENCE TO RELATED APPLICATIONS

This application is a continuation of, claims priority to and the benefit of, U.S. Ser. No. 17/135,373 filed Dec. 28, 2020 and entitled "CHAIR SYSTEM WITH AN UNTETHERED CHAIR WITH SPEAKERS" and assigned to the assignee hereof and hereby expressly incorporated by reference herein in its entirety for all purposes.

FIELD

A typical chair with speakers comprises two full-range speakers mounted below the headrest, next to or slightly behind the user's ears, with an optional sub-woofer mounted underneath the seat cushion at the base of the chair. The chair is typically connected to a power source and/or an external audio source through a wired interface. However, due to the desired flexibility in movement of the chair, having the wired connection is not ideal as the castor wheels of the chair may roll over and damage the wires, or a person may trip over the wire connected to the chair.

BACKGROUND

Thus, it can be seen that what is needed is a chair system with an untethered chair with speakers which is able to move freely, and be used safely. Furthermore, other desirable features and characteristics will become apparent from the subsequent detailed description and the appended claims, taken in conjunction with the accompanying drawings and this background of the disclosure.

SUMMARY

In one aspect of the invention, a chair system including a main unit and an untethered chair is provided. The main unit includes a wireless transmitter, a subwoofer, an audio stream receiver and a processor. The untethered chair includes a plurality of speakers, a power source and a wireless receiver for receiving a processed audio stream from the main unit.

In another aspect of the invention, a method of processing audio for a chair system having a main unit and an untethered chair is provided. The method includes receiving an audio stream at the main unit, processing the audio stream with a processor at the main unit to obtain a low frequency portion and a high frequency portion, sending the high frequency portion to a wireless receiver located at the untethered chair, playing the high frequency portion with a plurality of speakers located at the untethered chair, and playing the low frequency portion with a subwoofer.

DETAILED DESCRIPTION OF PREFERRED EMBODIMENTS

The following detailed description is merely exemplary in nature and is not intended to limit the invention or the application and uses of the invention. Furthermore, there is no intention to be bound by any theory presented in the preceding background of the invention or the following detailed description. It is an intent of the various embodiments to present a chair system with an untethered chair with speakers that can be moved freely, and used safely.

Figure 1:
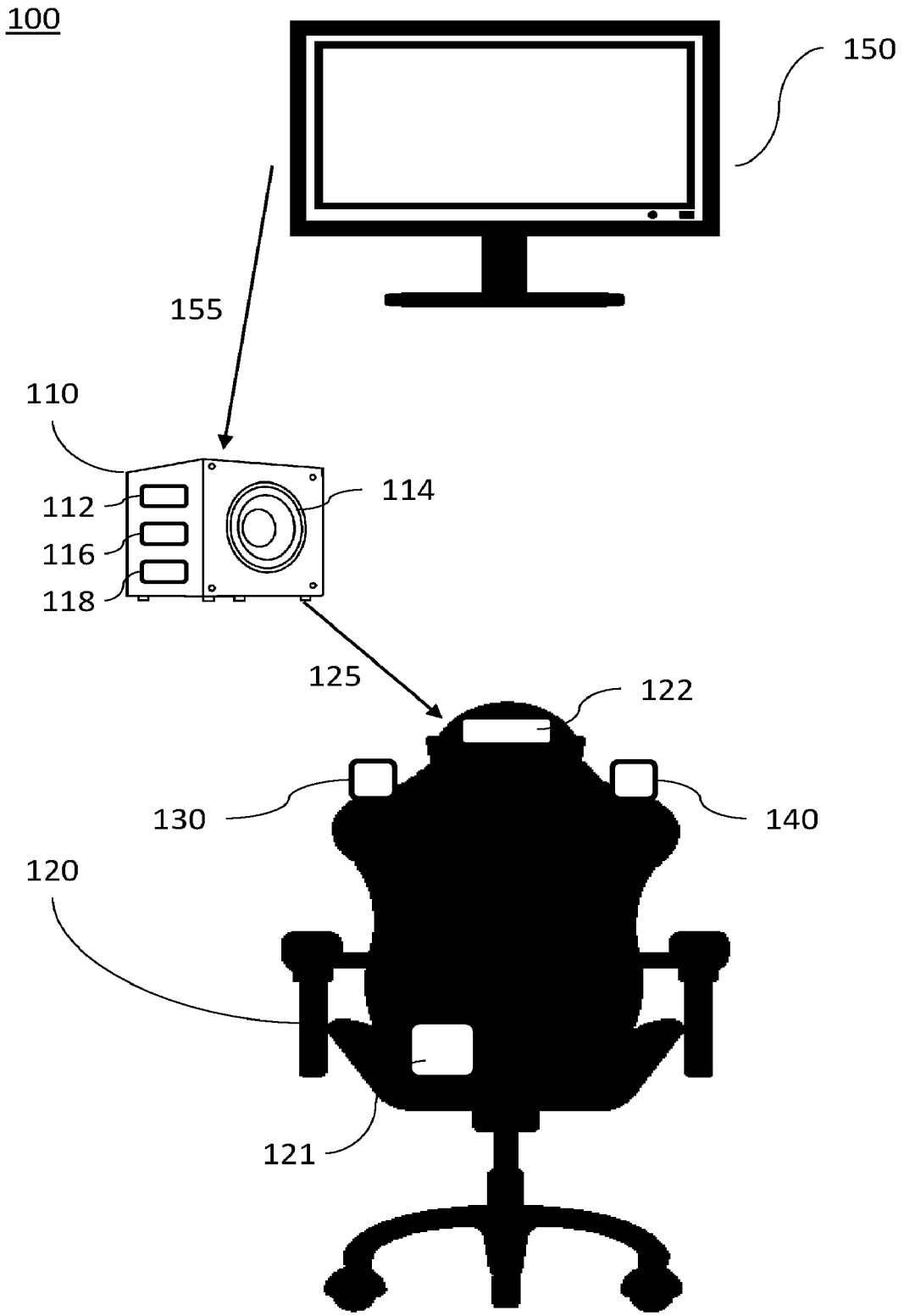
FIG. 1 is a system diagram of a chair system in accordance with various embodiments.

Referring to FIG. 1, a system diagram of a chair system 100 in accordance with various embodiments is shown. The chair system 100 includes a main unit 110 and an untethered chair 120. A wireless transmitter 112, a subwoofer 114, an audio stream receiver 116 and a processor 118 can be integrated in the main unit. The untethered chair 120 can include a power source 121, a wireless receiver 122 for receiving a processed audio stream from the wireless transmitter 112 on the main unit 110 via a wireless connection 125, and a plurality of speakers (130, 140). The audio stream receiver 116 can receive an audio stream from an external audio source 150 via a wired or wireless connection 155. In one embodiment, the received audio stream is processed by the processor 118 to obtain a low frequency portion and a high frequency portion. The high frequency portion may be processed to include 3D surround audio, using spatial audio technology such as but not limited to binaural processing using generic head-related transfer functions (HRTFs) and/or binaural room impulse response (BRIR). The high frequency portion is sent via the wireless connection 125 to the wireless receiver 122 on the untethered chair 120 as a processed audio stream. Alternatively, the received audio stream can be sent via the wireless connection 125 with the necessary processing done by another processor on the untethered chair 120. The high frequency portion is played on the plurality of speakers (130, 140) on the untethered chair, while the low frequency portion of the audio stream is played on the subwoofer 114. In one embodiment, the subwoofer can be integrally coupled to the main unit 110 (as shown). An appropriate delay can be added to the low frequency portion to ensure audio synchronization between the high frequency portion played at the plurality of speakers (130, 140) at the untethered chair 120, and the low frequency portion played at the main unit 110. In another embodiment, the subwoofer 114 can be coupled to the main unit 110 via a wired or wireless connection (not shown). In one embodiment, the high frequency portion can be the portion of the audio stream that has audio frequencies above a threshold frequency (e.g. preferably around 200 to 500 Hz and more preferably around 300 Hz), and the low frequency portion can be the portion of the audio stream that has audio frequencies at or below the threshold frequency. Advantageously, the power requirements for the untethered chair is reduced because the low frequency components (at or below the threshold frequency) of the audio stream do not need to be reproduced by the plurality of speakers (130, 140) on the untethered chair 120. The audio frequencies of the full human vocal range for intelligibility can also be considered while selecting a suitable threshold frequency, especially in the embodiments without frontal speakers. For example, the frequency range between 250 Hz and 4 kHz is of high importance for intelligibility. With the reduced power consumption, the untethered chair does not have to be constantly plugged into a wall socket, but can use a power source 121 such as a user-removable battery, a power bank, or the like. Advantageously, the untethered chair can be moved or rolled around without the risk of rolling over and damaging any connected wires, or having the risk of a person tripping over any wires connected to the chair. The main unit 110 can be placed near to a power socket, and plugged directly through a wired connection to the power socket for power. The main unit 110 can be placed near to an external audio source 150. In a preferred embodiment, most of the audio processing is carried out by the processor 118 on the main unit 110, further reducing the power consumption of the untethered chair 120. The audio stream receiver 116 can receive audio from the external audio source 150 via a wired, or wireless connection 155.

Figure 2:
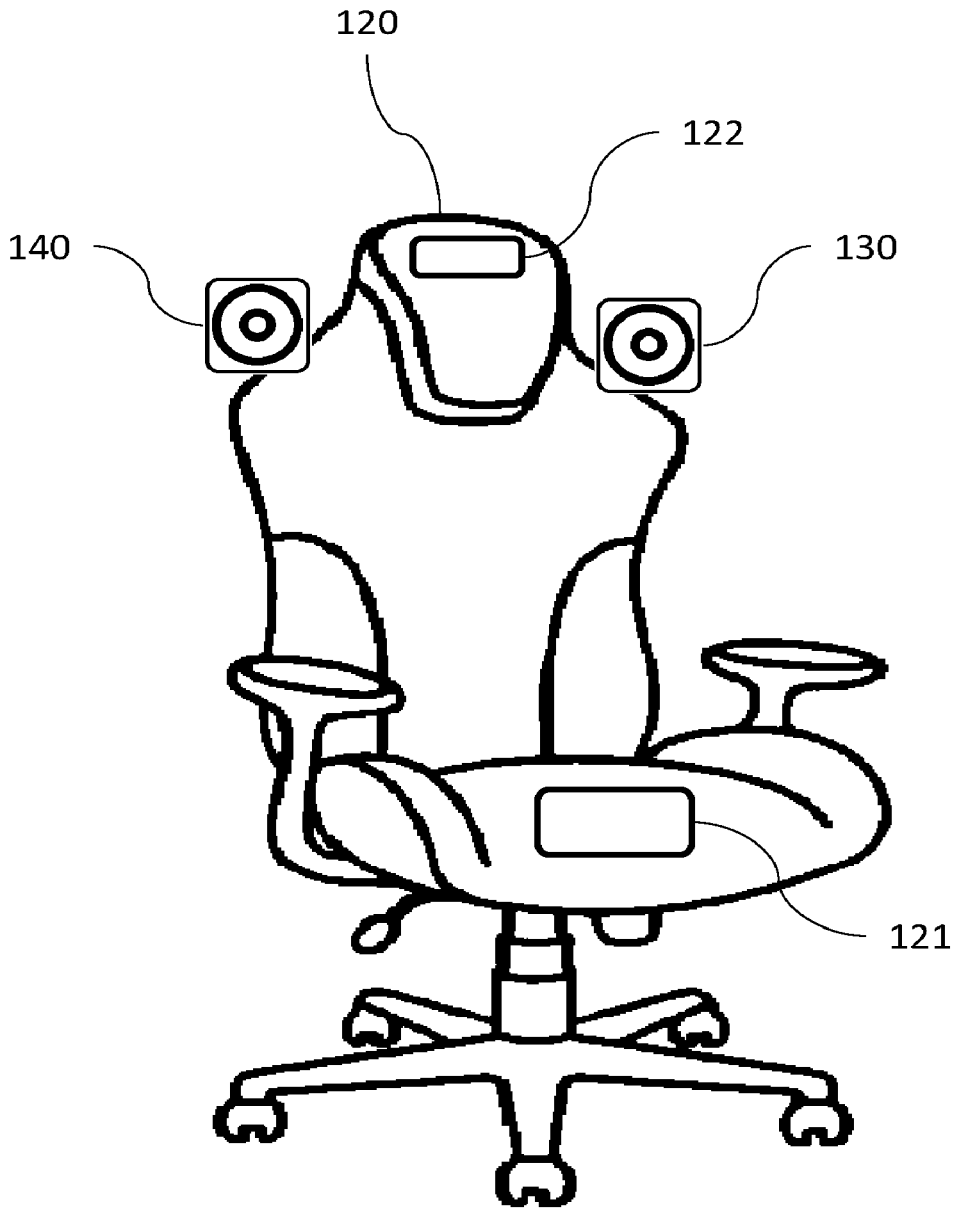
FIG. 2 is a system diagram of an untethered chair in accordance with various embodiments.

Referring to FIG. 2, a system diagram 200 of an untethered chair 120 in accordance with various embodiments is shown. The plurality of speakers (130, 140) is mounted in a position besides or close to the position of the user's ears, at least one on each side of the user. Even though the figure shows that the plurality of speakers (130, 140), power source (121) and wireless receiver (122) are separate, they can also be designed as a single module, with the power source 121 and wireless receiver 122 integrated into the single module along with the plurality of speakers (130, 140). In this case, the whole module can be removably coupled to the untethered chair while in use, and removed for charging. Interconnection of the plurality of speakers (130, 140), power source (121) and wireless receiver (122) is preferably wired, so that latency is reduced.

Figure 3:
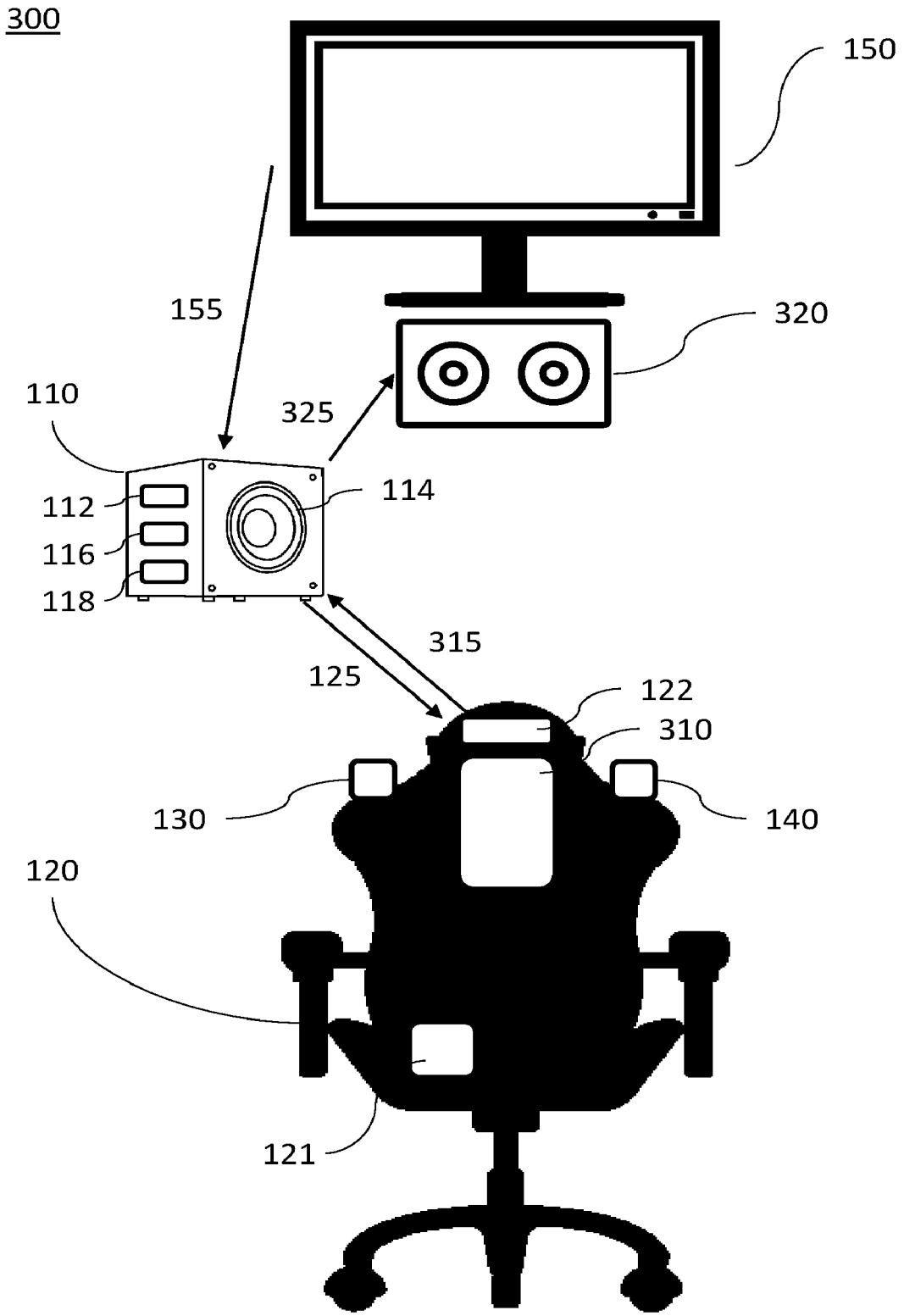
FIG. 3 is a system diagram of a chair system in accordance with various embodiments.

Referring to FIG. 3, a system diagram of a chair system 300 in accordance with various embodiments is shown. The chair system 300 includes a main unit 110, an untethered chair 120, and a plurality of frontal speaker 320. A wireless transmitter 112, a subwoofer 114, an audio stream receiver 116, and a processor 118 can be integrated in the main unit. The untethered chair 120 can include a power source 121, a wireless receiver 122 for receiving a processed audio stream from the wireless transmitter 112 on the main unit 110 via a wireless connection 125, a plurality of speakers (130, 140), and a posture sensor module 310. The posture sensor module 310 includes at least one posture sensor, and a posture transmitter. The audio stream receiver 116 in the main unit 110 can receive an audio stream from an external audio source 150 via a wired or wireless connection 155. The posture sensor module 310 on the untethered chair 120 detects and sends a position of a user on the untethered chair 120 to the processor 118 at the main unit 110 with the posture transmitter via a wireless connection 315. In one embodiment, the received audio stream 155 is processed by the processor 118 to obtain a low frequency portion, a high frequency portion and a frontal portion. The high frequency portion and/or the frontal portion may be processed to include 3D surround audio, using spatial audio technology such as but not limited to binaural processing using generic head-related transfer functions (HRTFs) and/or binaural room impulse response (BRIR). The frontal portion is sent via a wired or wireless connection 325 to the plurality of frontal speaker 320 to be played. The high frequency portion is processed according to the position of the user, and is sent to the wireless receiver 122 on the untethered chair 120 as a processed audio stream via wireless connection 125. For example, when the position of the user is detected as leaning fully against the backrest of the chair with user's head leaning on the headrest, the plurality of speakers (130, 140) on the chair can be considered as left speaker and right speaker respectively, and the high frequency portion is processed accordingly. However, if the position of the user is detected as leaning forward from the backrest of the chair, the plurality of speakers (130, 140) on the chair can be considered as rear-left speaker and rear-right speaker respectively, and the high frequency portion processed accordingly. Another possible position of the user is leaning on the backrest of the chair, but user's head is not leaning on the headrest. In this case, the plurality of speakers (130, 140) can, for example, be considered as in a position between the left and rear-left, and between the right and the rear-right respectively, and the high frequency portion processed accordingly. The position of the user may be detected in real-time, and the high frequency portion processed accordingly in real-time as well. The high frequency portion is played on the plurality of speakers (130, 140) on the untethered chair, while the low frequency portion of the audio stream is played on the subwoofer 114. Alternatively, the received audio stream can be sent via the wireless connection 125 with the necessary processing done by another processor on the untethered chair 120. In one embodiment, the subwoofer can be integrally coupled to the main unit 110 (as shown). An appropriate delay can be added to the low frequency portion, the frontal portion and/or the high frequency portion to ensure audio synchronization between the high frequency portion played at the plurality of speakers (130, 140) at the untethered chair 120, the frontal portion played at the plurality of frontal speaker 320, and the low frequency portion played at the main unit 110. In another embodiment, the subwoofer 114 can be coupled to the main unit 110 via a wired or wireless connection (not shown). In one embodiment, the high frequency portion can be the portion of the audio stream that has audio frequencies above a threshold frequency (e.g. preferably around 200 to 500 Hz and more preferably around 300 Hz), and the low frequency portion can be the portion of the audio stream that has audio frequencies at or below the threshold frequency. The frontal portion can have a broad frequency range (e.g. from 50 Hz to 20 kHz) which overlaps with the high frequency portion, and/or the low frequency portion. Advantageously, the power requirements for the untethered chair is reduced because the low frequency components (at or below the threshold frequency) of the audio stream do not need to be reproduced by the plurality of speakers (130, 140) on the untethered chair 120. The audio frequencies of the full human vocal range can also be considered while selecting a suitable threshold frequency, especially in the embodiments without frontal speakers. With the reduced power consumption, the untethered chair does not have to be constantly plugged into a wall socket, but can use a power source 121 such as a user-removable battery, a power bank, or the like. Advantageously, the untethered chair can be moved or rolled around without the risk of rolling over and damaging any connected wires, or having the risk of a person tripping over any wires connected to the chair. The main unit 110 can be placed near to a power socket, and plugged directly through a wired connection to the power socket for power. The main unit 110 can be placed near to an external audio source 150, and/or the plurality of frontal speakers 320. In a preferred embodiment, most of the audio processing is carried out by the processor 118 on the main unit 110, further reducing the power consumption of the untethered chair 120. The audio stream receiver 116 can receive audio from the external audio source 150 via a wired, or wireless connection 155.

Figure 4:
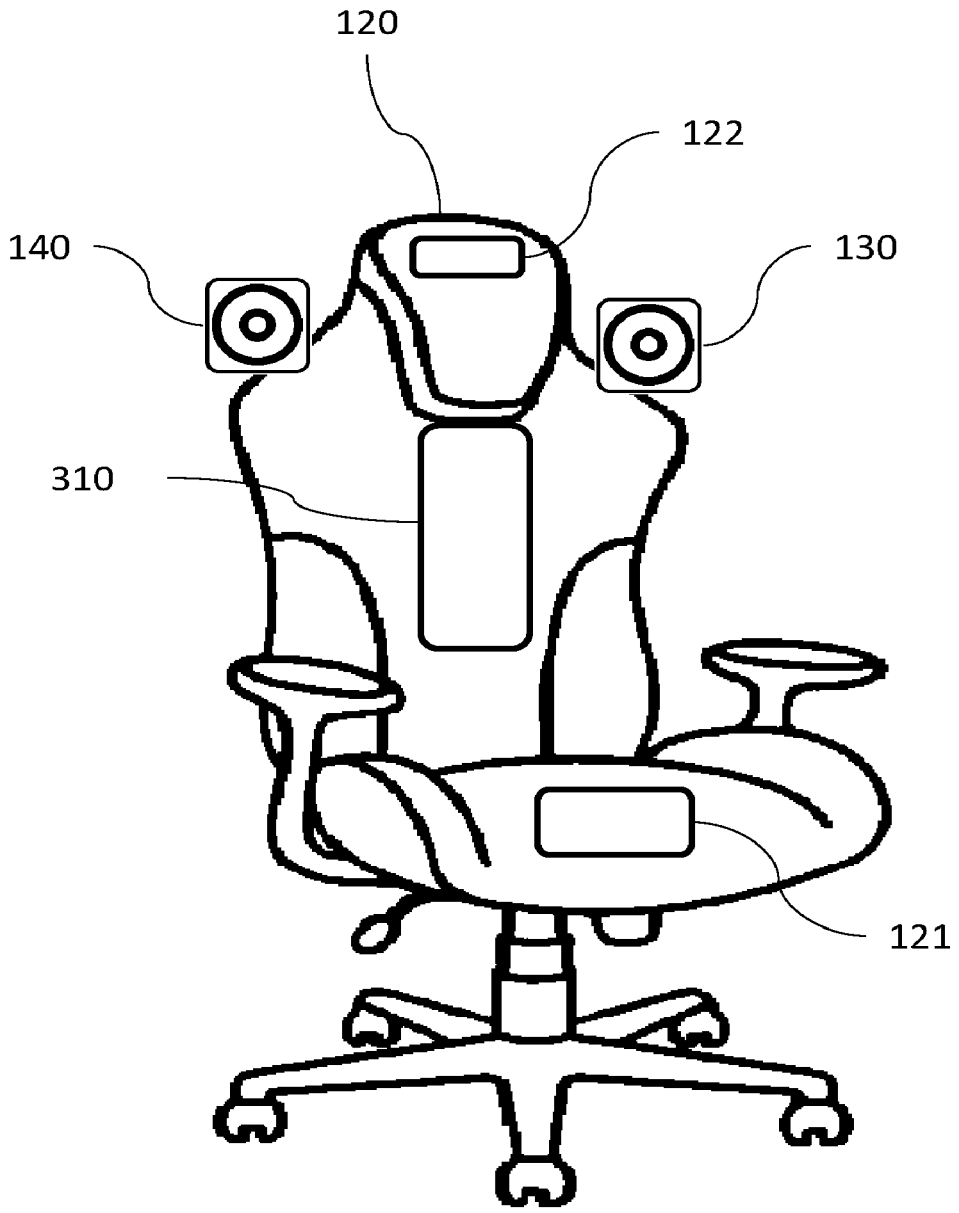
FIG. 4 is a system diagram of an untethered chair in accordance with various embodiments.

Referring to FIG. 4, a system diagram 400 of an untethered chair 120 in accordance with various embodiments is shown. The plurality of speakers (130, 140) is mounted in a position besides or close to the position of the user's ears, one on each side. Even though the figure shows that the plurality of speakers (130, 140), power source (121) and wireless receiver (122) are separate, they can also be designed as a single module, with the power source 121 and wireless receiver 122 integrated into the single module. In this case, the whole module can be removably coupled to the untethered chair while in use, and removed for charging when needed. In one embodiment, a posture sensor module 310 can also be integrated in the untethered chair 120. The posture sensor module may have at least one posture sensor and a posture transmitter. Although the posture transmitter and the wireless receiver 122 are shown to be separate, the posture transmitter and the wireless receiver 122 may be combined in a single transceiver, instead of being two separate components. Sensor module 310 can be powered by power source 121. The at least one posture sensor can be located at or near the headrest and/or at or near the backrest of the untethered chair, the at least one posture sensor positioned to detect a position of the user, in particular the position of the head, shoulder and/or back of the user on the chair.

In one embodiment, the main unit 110 may have a receiving means such as but not limited to a card reader, a data entry interface, a transceiver, an Internet connection or USB port for receiving a set of personalization data of the user. The set of personalization data may include the user's HRTF, for example, a personalized HRTF or a generalized representation of the user's HRTF determined through best-match basis to a general grouping of HRTFs, and/or the user's anthropometric measurements or approximation of his ear(s) and upper torso. The received audio stream is processed by processor 118 in the main unit 110 to generate the high frequency portion and/or frontal portion with 3D surround audio based on the personalization data of the user. Alternatively, the receiving means can be located on the untethered chair, and the received audio stream processed by a processor that is located on the untethered chair. Advantageously, by processing the audio stream based on the personalization data of the user, the spatial effect of the high frequency portion and/or frontal portion is made even more realistic, further enhancing the user's experience when using the chair system. The chair system can process audio and generate personalized HRTF using any suitable technique. For example, the techniques as disclosed in U.S. application Ser. No. 16/853,676, U.S. patent Ser. No. 10/225,682, and U.S. patent Ser. No. 10/390,171, which are hereby incorporated by reference, can be used. The personalization data may also include audio characteristics of the plurality of speakers (130, 140) on the untethered chair and/or the plurality of frontal speaker 320, and the processing of high frequency portion and/or frontal portion with 3D surround audio further improved, for example, by processing based on applying a suitable equalizer setting based on the audio characteristics of the plurality of speakers (130, 140) and/or the plurality of frontal speaker 320. Advantageously, by processing the audio stream based on the audio characteristics of the plurality of speakers (130, 140) and/or the plurality of frontal speaker 320, the audio effect of the high frequency portion and/or frontal portion is further improved, further enhancing the user's experience when using the chair.

Figure 5:
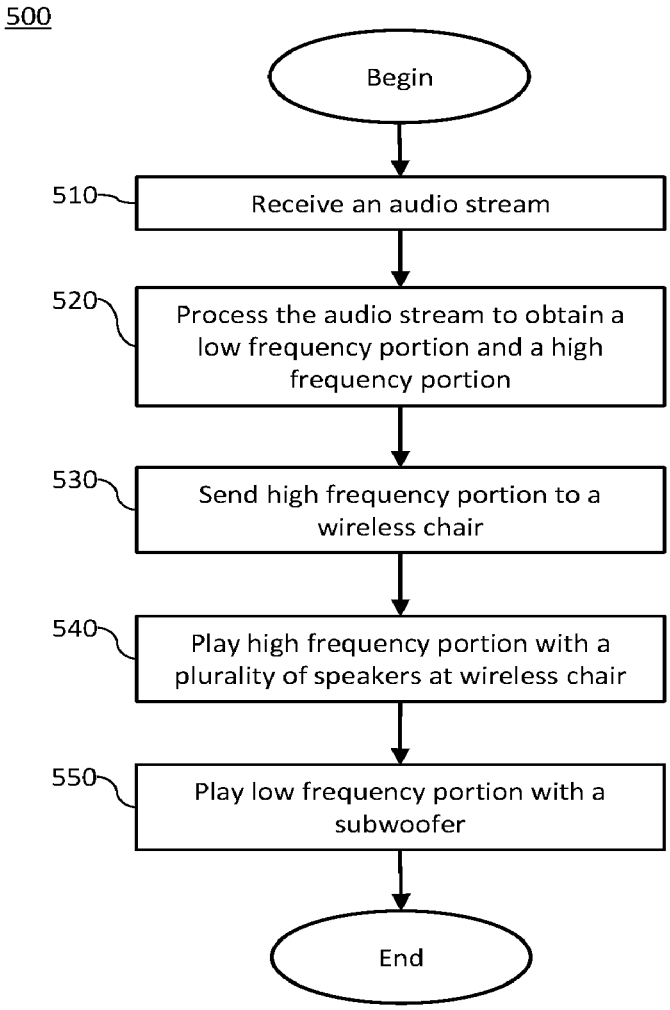
FIG. 5 is a flow diagram depicting a method of processing audio for a chair system in accordance with various embodiments.

Referring to FIG. 5, a flow diagram 500 depicting a method of processing audio for a chair system in accordance with various embodiments is shown. A chair system including a main unit and an untethered chair is provided. An audio stream is received in step 510, and the audio stream is processed to obtain a low frequency portion and a high frequency portion in step 520. The processor can be located in the main unit, or in the untethered chair. The processor is preferably located in the main unit to reduce the power consumption of the untethered chair, especially if complex audio processing is to be carried out. In one embodiment, the low frequency portion can, for example, be the portion of the audio stream that has audio frequencies at and below a threshold frequency (e.g. preferably around 200 to 500 Hz and more preferably around 300 Hz) while the high frequency portion can, for example, be the portion of the audio stream that has audio frequencies above the threshold frequency. In one embodiment, a processor checks if personalization data has been received via a receiving means such as but not limited to a card reader, a data entry interface, a transceiver, an Internet connection or USB port for receiving a set of personalization data of the user. When the check indicates that no personalization data has been received, the processor will load a set of generic data. On the other hand, when personalization data has been received, the processor will load the personalized data. The personalization data may include the user's HRTF, for example, a personalized HRTF or a generalized representation of the user's HRTF determined through best-match basis to a general grouping of HRTFs, and/or the user's anthropometric measurements or approximation of his ear(s) and upper torso. The personalization data may alternatively or in combination also include characteristics of the plurality of speakers on the untethered chair, and the processing of high frequency portion with 3D surround audio further improved, for example, by processing based on applying a suitable equalizer setting based on the characteristics of the plurality of speakers. Advantageously, by processing the audio stream based on the characteristics of the plurality of speakers, the audio effect of the high frequency portion is further improved, further enhancing the user's experience when using the chair. The received audio stream is processed by the processor to obtain the high frequency portion. Advantageously, by processing the audio using spatial audio technology, the user's experience when playing the game is enhanced by heightening his listening experience through realistic 3D surround audio. More advantageously, by processing the audio based on the personalization data of the user, the spatial effect of the high frequency portion is made even more realistic, further enhancing the user's experience when playing the game. The chair system can process audio and generate personalized HRTF using any suitable technique. For example, the techniques as disclosed in U.S. application Ser. No. 16/853,676, U.S. patent Ser. No. 10/225,682, and U.S. patent Ser. No. 10/390,171, which are hereby incorporated by reference, can be used.

In optional step 530, the high frequency portion is sent to a wireless receiver located at the untethered chair if the processor is located on the main unit. The untethered chair plays the high frequency portion with a plurality of speakers coupled with the untethered chair in step 540. In one embodiment, the plurality of speakers can be removably coupled. In step 550, the low frequency portion is played with a subwoofer. In one embodiment, the subwoofer can be integrally coupled to the main unit. An appropriate delay can be added to the low frequency portion to ensure audio synchronization between the high frequency portion played at the plurality of speakers at the untethered chair, and the low frequency portion played at the subwoofer. In another embodiment, the subwoofer can be coupled to the main unit via a wired or wireless connection.

Figure 6:
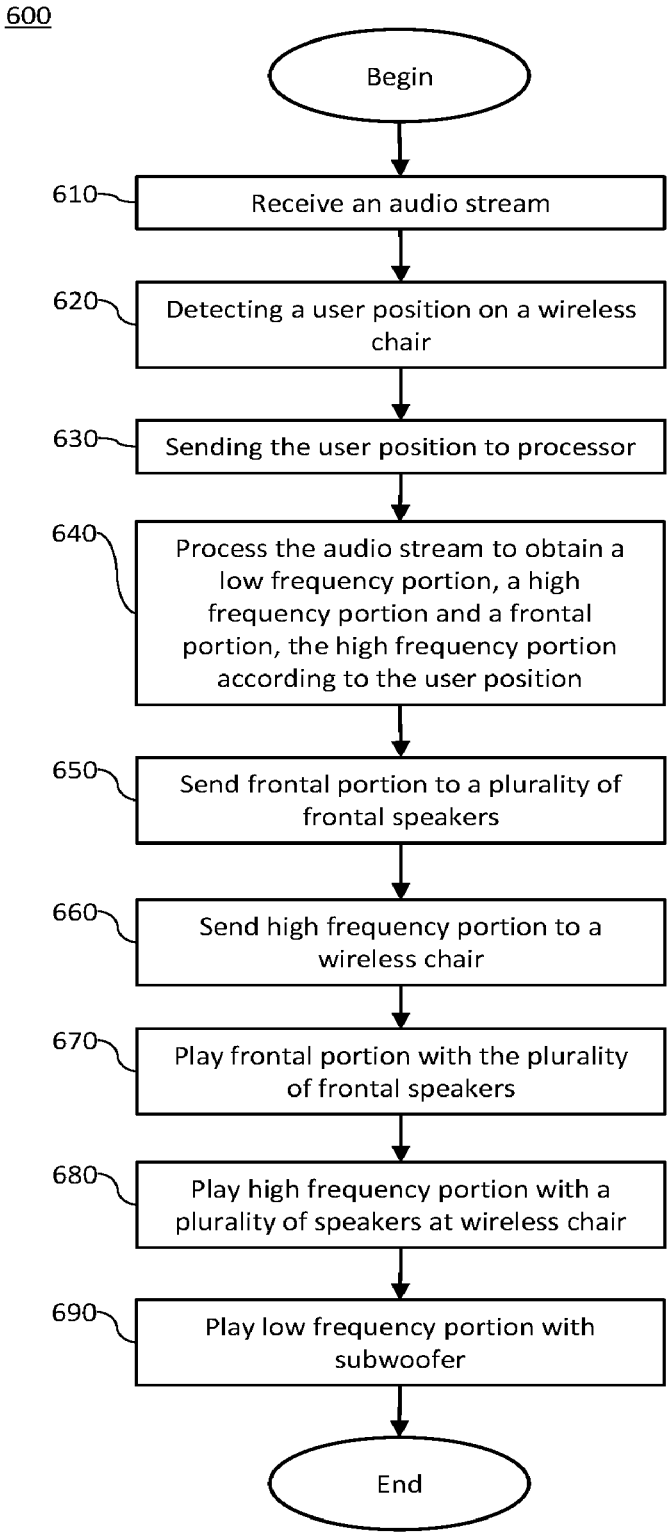
FIG. 6 is a flow diagram depicting a method of processing audio for a chair system in accordance with various embodiments.

Referring to FIG. 6, a flow diagram 600 depicting a method of processing audio for a chair system in accordance with various embodiments is shown. A chair system including a main unit, an untethered chair, and a plurality of frontal speaker is provided. An audio stream is received in step 610, and a position of a user on the untethered chair is detected by a posture sensor module on the untethered chair in step 620. A processor can be located in the main unit, or in the untethered chair. The processor is preferably located in the main unit to reduce the power consumption of the untethered chair, especially if complex audio processing is to be carried out. In step 630, the position of the user on the untethered chair is sent by a posture transmitter to the processor. In step 640, the audio stream is processed to obtain a low frequency portion, a high frequency portion, and a frontal portion. The high frequency portion is processed according to the position of the user. For example, when the position of the user is detected as leaning fully against the chair with user's head leaning on the headrest, the plurality of speakers on the chair can be considered as left speaker and right speaker respectively, and the high frequency portion processed accordingly. However, if the position of the user is detected as leaning forward from the backrest of the chair, the plurality of speakers on the chair can be considered as rear-left speaker and rear-right speaker respectively, and the high frequency portion processed accordingly. Another possible position of the user is the user leaning on the backrest of the chair, but the user's head is not leaning on the headrest. In this case, the plurality of speakers can, for example, be considered as in a position between the left and rear-left, and between the right and the rear-right respectively, and the high frequency portion processed accordingly. The position of the user may be detected in real-time, and the high frequency portion processed accordingly in real-time as well. In one embodiment, the low frequency portion can, for example, be the portion of the audio stream that has audio frequencies at or below a threshold frequency (e.g. preferably around 200 to 500 Hz and more preferably around 300 Hz) while the high frequency portion can, for example, be the portion of the audio stream that has audio frequencies above the threshold frequency.

In one embodiment, a processor checks if personalization data has been received via a receiving means such as but not limited to a card reader, a data entry interface, a transceiver, an Internet connection or USB port for receiving a set of personalization data of the user. When the check indicates that no personalization data has been received, the processor will load a set of generic data. On the other hand, when personalization data has been received, the processor will load the personalized data. The personalization data may include the user's HRTF, for example, a personalized HRTF or a generalized representation of the user's HRTF determined through best-match basis to a general grouping of HRTFs, and/or the user's anthropometric measurements or approximation of his ear(s) and upper torso. The personalization data may alternatively or in combination also include characteristics of the plurality of speakers on the untethered chair and/or the plurality of frontal speaker, and the processing of high frequency portion and/or frontal portion with 3D surround audio further improved, for example, by processing based on applying a suitable equalizer setting based on the characteristics of the plurality of speakers and/or the plurality of frontal speaker. Advantageously, by processing the audio stream based on the characteristics of the plurality of speakers and/or the plurality of frontal speaker, the audio effect of the high frequency portion is further improved, further enhancing the user's experience when using the chair. The received audio stream is processed by the processor to obtain the high frequency portion. Advantageously, by processing the audio using spatial audio technology, the user's experience when playing the game is enhanced by heightening his listening experience through realistic 3D surround audio. More advantageously, by processing the audio based on the personalization data of the user, the spatial effect of the high frequency portion and/or frontal portion is made even more realistic, further enhancing the user's experience when playing the game. The chair system can process audio and generate personalized HRTF using any suitable technique. For example, the techniques as disclosed in U.S. application Ser. No. 16/853,676, U.S. patent Ser. No. 10/225,682, and U.S. patent Ser. No. 10/390,171, which are hereby incorporated by reference, can be used.

In step 650, the frontal portion is sent to the plurality of frontal speaker. The high frequency portion is sent to a wireless receiver located at the untethered chair in optional step 660, when the processor is located on the main unit. The frontal portion is played with the plurality of frontal speaker in step 670, the high frequency portion is played with the plurality of speakers on the untethered chair in step 680, and the low frequency portion is played with a subwoofer in step 690. The subwoofer is integrally coupled to the main unit, or coupled to the main unit via a wired or wireless connection. An appropriate delay can be added to the high frequency portion, the frontal portion and/or the low frequency portion to ensure audio synchronization between the high frequency portion played at the plurality of speakers at the untethered chair, the frontal portion played at the plurality of frontal speaker, and the low frequency portion. In another embodiment, the subwoofer can be coupled to the main unit via a wired or wireless connection.

Although the steps in the flow diagrams are given sequentially, it should be appreciated that some of the steps can be performed concurrently, or in a different sequence. The steps described may be implemented in hardware, software, firmware, or any combination thereof.

Thus, it can be seen that a chair system with an untethered chair with speakers has been provided. An advantage of the present invention is that it provides a way for the untethered chair to be moved freely, and used safely.

While exemplary embodiments have been presented in the foregoing detailed description of the present embodiments, it should be appreciated that a vast number of variations exists. It should further be appreciated that the exemplary embodiments are only examples, and are not intended to limit the scope, applicability, operation, or configuration of the invention in any way. Rather, the foregoing detailed description will provide those skilled in the art with a convenient road map for implementing exemplary embodiments of the invention, it being understood that various changes may be made in the function and arrangement of steps and method of operation described in the exemplary embodiments without departing from the scope of the invention as set forth in the appended claims. For example, headphones can be provided to work in conjunction with the system described, and could either replace or supplement the plurality of frontal speakers, and/or replace or supplement the plurality of speakers on the untethered chair.

We claim:

1. A chair system comprising:

a main unit comprising:

an audio stream receiver configured to receive an audio stream;

a processor configured to process the audio stream into a processed audio stream;

a wireless transmitter; and a subwoofer configured to receive a low frequency portion of the processed audio stream with audio frequencies at or below a threshold frequency; and an untethered chair comprising:

a plurality of speakers;

a power source; and a wireless receiver configured for receiving, from the wireless transmitter of the main unit, a high frequency portion of the processed audio stream with audio frequencies above the threshold frequency and configured for providing the high frequency portion to the plurality of speakers, wherein the main unit is physically separated from the untethered chair.

2. The chair system of claim 1, wherein the main unit processes the audio stream with the processor at the main unit to obtain the low frequency portion with the audio frequencies at or below the threshold frequency and the high frequency portion with the audio frequencies above the threshold frequency, sends the high frequency portion to the wireless receiver for playing the high frequency portion with the plurality of speakers, and plays the low frequency portion with the subwoofer.

3. The chair system of claim 2, further comprising:

a plurality of frontal speakers, wherein the untethered chair further comprises a posture sensor module with at least one posture sensor and a posture transmitter, wherein the posture sensor module is configured to detect and send a position of a user on the untethered chair to the processor, wherein the processor is configured to process the high frequency portion according to the position of the user, and wherein the processor is configured to process the audio stream to obtain a frontal portion, and is configured to send the frontal portion to the untethered chair for playing at the plurality of frontal speakers.

4. The chair system of claim 3, further comprising:

a receiving means configured to receive a set of personalization data of the user, wherein the audio stream is processed according to the set of personalization data.

5. The chair system of claim 4, wherein the audio stream is processed according to audio characteristics of the plurality of speakers on the untethered chair.

6. The chair system of claim 2, wherein an appropriate delay is added to at least one of the low frequency portion or the high frequency portion to ensure audio synchronization between the low frequency portion and the high frequency portion.

7. The chair system of claim 3, wherein an appropriate delay is added to at least one of the low frequency portion, the high frequency portion or the frontal portion to ensure audio synchronization between the low frequency portion, and the high frequency and the frontal portion.

8. The chair system of claim 1, wherein the power source is a user-removable battery.

9. The chair system of claim 1, wherein the audio stream receiver has a wired or wireless connection to an external audio source.

10. The chair system of claim 1, wherein the subwoofer is at least one of integrally coupled to the main unit, coupled wired to the main unit or coupled wirelessly to the main unit.

11. The chair system of claim 1, wherein the subwoofer is configured to receive from at least one of the wireless transmitter or the processor the low frequency portion of the processed audio stream with the audio frequencies at or below the threshold frequency.

12. A method of processing audio for a chair system having a main unit and an untethered chair, the method comprising:

receiving an audio stream with an audio stream receiver at the main unit;

processing the audio stream with a processor at the main unit to obtain a processed audio stream having a low frequency portion with audio frequencies at or below a threshold frequency and a high frequency portion with audio frequencies above the threshold frequency;

transmitting, from a wireless transmitter of the main unit to a wireless receiver of the untethered chair, a high frequency portion of the processed audio stream with audio frequencies above the threshold frequency;

playing the high frequency portion with a plurality of speakers on the untethered chair;

transmitting to a subwoofer the low frequency portion of the processed audio stream with audio frequencies at or below a threshold frequency; and playing the low frequency portion with the subwoofer coupled to the main unit, wherein the main unit is physically separated from the untethered chair.

13. The method of claim 12, wherein at least one of the playing the low frequency portion or the playing the high frequency portion further comprise adding an appropriate delay to ensure audio synchronization between the low frequency portion and the high frequency portion.

14. The method of claim 12, further comprising:

providing a plurality of frontal speakers;

detecting a position of a user on the untethered chair with a posture sensor module having at least one posture sensor and a posture transmitter, and sending the position of the user to the processor;

processing the high frequency portion according to the position of the user;

processing the audio stream with the processor to obtain a frontal portion, and sending the frontal portion to the plurality of frontal speakers; and playing the frontal portion with the plurality of frontal speakers.

15. The method of claim 14, further comprising adding an appropriate delay to at least one of the low frequency portion, the high frequency portion or the frontal portion to ensure audio synchronization between the low frequency portion, the high frequency and the frontal portion.

16. The method of claim 15, further comprising:

receiving a set of personalization data of the user with a receiving means; and processing the audio stream according to the set of personalization data.

17. The method of claim 16, further comprising processing the audio stream according to audio characteristics of the plurality of speakers on the untethered chair.

18. The method of claim 12, wherein the audio stream receiver has a wired or wireless connection to an external audio source.

19. The method of claim 12, wherein the subwoofer is at least one of integrally coupled to the main unit, coupled wired to the main unit or coupled wirelessly to the main unit.

20. The method of claim 12, wherein the transmitting to the subwoofer comprises transmitting from at least one of the wireless transmitter or the processor.

* * * * *